US010104459B2

(12) United States Patent
Chen et al.

(10) Patent No.: US 10,104,459 B2
(45) Date of Patent: Oct. 16, 2018

(54) AUDIO SYSTEM WITH CONCEAL DETECTION OR CALIBRATION

(71) Applicant: HTC Corporation, Taoyuan (TW)

(72) Inventors: Lei Chen, Taoyuan (TW); Hann-Shi Tong, Taoyuan (TW); Yu-Chieh Lai, Taoyuan (TW); Hsiu-Po Yang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 35 days.

(21) Appl. No.: 15/293,294

(22) Filed: Oct. 14, 2016

(65) Prior Publication Data

US 2018/0109865 A1 Apr. 19, 2018

(51) Int. Cl.

| | |
|---|---|
| ***H04R 1/10*** | (2006.01) |
| ***H04R 3/04*** | (2006.01) |
| ***H04R 29/00*** | (2006.01) |
| *H04R 5/04* | (2006.01) |

(52) U.S. Cl.

CPC ..... *H04R 1/1041* (2013.01); *H04R 1/1016* (2013.01); *H04R 3/04* (2013.01); *H04R 29/00* (2013.01); *H04R 29/001* (2013.01); *H04R 5/04* (2013.01); *H04R 2460/05* (2013.01); *H04R 2460/15* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,338,555 | B1 * | 5/2016 | Oxford | H04R 5/033 |
| 9,609,436 | B2 * | 3/2017 | Gamper | H04R 5/0335 |
| 2001/0036277 | A1 * | 11/2001 | Stone | A61B 5/121 381/60 |
| 2010/0074451 | A1 | 3/2010 | Usher et al. | |

(Continued)

FOREIGN PATENT DOCUMENTS

| | | | |
|---|---|---|---|
| CN | 102411936 | B | 11/2012 |
| EP | 1940198 | A2 | 7/2008 |

(Continued)

OTHER PUBLICATIONS

Corresponding European Search Report dated Nov. 27, 2017.
Corresponding Taiwanese office action dated Jan. 11, 2018.

*Primary Examiner* — Duc Nguyen
*Assistant Examiner* — Assad Mohammed
(74) *Attorney, Agent, or Firm* — CKC & Partners Co., Ltd.

(57) ABSTRACT

An audio system includes a headset and a control device. The headset includes a housing, a speaker and a microphone. When the headset is mounted on an ear, the housing is configured for forming a cavity along with an external auditory canal of the ear. The speaker and the microphone are disposed in the housing. The control device is coupled to the headset. The control device is operable to provide a reference audio signal to the speaker to be broadcasted toward the cavity, further to receive a sampled sound signal through the microphone corresponding to a reflection of the reference audio signal from the cavity, further to calculate an acoustic intensity distribution curve over frequencies from the sampled sound signal, and further to determine whether the cavity has a leakage outlet according to the acoustic intensity distribution curve over frequencies.

20 Claims, 13 Drawing Sheets

(56) References Cited

U.S. PATENT DOCUMENTS

| | | | | |
|---|---|---|---|---|
| 2010/0092001 | A1 | 4/2010 | Saltykov et al. | |
| 2010/0232622 | A1* | 9/2010 | Kasanmascheff | H04R 25/50 381/94.2 |
| 2011/0116643 | A1 | 5/2011 | Tiscareno et al. | |
| 2012/0039489 | A1* | 2/2012 | Chen | H03G 3/32 381/107 |
| 2013/0216060 | A1 | 8/2013 | Narayan et al. | |
| 2016/0014493 | A1 | 1/2016 | Chen | |
| 2016/0267899 | A1* | 9/2016 | Gauger, Jr. | G10K 11/175 |
| 2016/0330546 | A1* | 11/2016 | Barrentine | H04R 3/04 |
| 2017/0048608 | A1* | 2/2017 | Yang | H04R 1/1083 |

FOREIGN PATENT DOCUMENTS

| | | | |
|---|---|---|---|
| WO | 2009023633 | A1 | 2/2009 |
| WO | 2014071537 | A1 | 5/2014 |

* cited by examiner

AUDIO SYSTEM WITH CONCEAL DETECTION OR CALIBRATION

BACKGROUND

Technical Field

The present invention relates to an audio system and a control method thereof. More particularly, the present invention relates to an audio system able to perform conceal detection or sound calibration.

Description of Related Art

Typically, sound is transmitted as wave over air. Sound effect experienced by a user is affected by many factors, such as an environment (e.g., outdoor, indoor, in a concert hall or in a small room), characteristics of audio playing equipment and/or ear structures of users. Audio systems usually equip sound equalizers to simulate different environments or compensate the audio output. An audio playback setting (e.g., a sound equalizer setting, a noise filter setting or a volume setting) is manually selected from some default sound profiles.

Users may select their favorite default sound profile or adjust parameters in the sound profiles to achieve the optimal configuration on their own. However, when users purchase new audio-playing devices (e.g., headsets, earphones, speakers) or switch between different audio-playing devices, they have to repeat the setting procedure again. In other cases, when there are different users who newly join to listen to the audio system, the existed configurations applied on the audio system may not be optimal to the current users because everyone may have different ear structures.

SUMMARY

The disclosure provides an audio system, which includes a headset and a control device. The headset includes a housing, a speaker and a microphone. When the headset is mounted on an ear, the housing is configured for forming a cavity along with an external auditory canal of the ear. The speaker is disposed in the housing. The microphone is disposed in the housing. The control device is coupled to the headset. The control device is operable to provide a reference audio signal to the speaker to be broadcasted toward the cavity. The control device is further operable to receive a sampled sound signal through the microphone corresponding to a reflection of the reference audio signal from the cavity. The control device is further operable to calculate an acoustic intensity distribution curve over frequencies from the sampled sound signal. The control device is further operable to determine whether the cavity has a leakage outlet according to the acoustic intensity distribution curve over frequencies.

The disclosure provides an audio system, which includes a headset and a control device. The headset includes a housing, a speaker and a microphone. When the headset being mounted on an ear, the housing is configured for forming a cavity along with an external auditory canal of the ear. The speaker is disposed in the housing. The microphone is disposed in the housing. The control device is coupled to the headset. The control device is operable to provide a reference audio signal to the speaker to be broadcasted toward the cavity. The control device is further operable to receive a sampled sound signal through the microphone corresponding to a reflection of the reference audio signal from the cavity. The control device is further operable to calculate an acoustic intensity distribution curve over frequencies from the sampled sound signal. The control device is further operable to calculate a compensation filter according to the acoustic intensity distribution curve over frequencies.

The disclosure provides a control method which is suitable for a headset. The control method includes following operations. A reference audio signal is provided to be broadcasted toward a cavity, which is formed by the headset and an external auditory canal of an ear. A sampled sound signal is received by the headset corresponding to a reflection of the reference audio signal from the cavity. An acoustic intensity distribution curve over frequencies is calculated from the sampled sound signal. Whether the cavity has a leakage outlet or not is determined according to the acoustic intensity distribution curve over frequencies.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
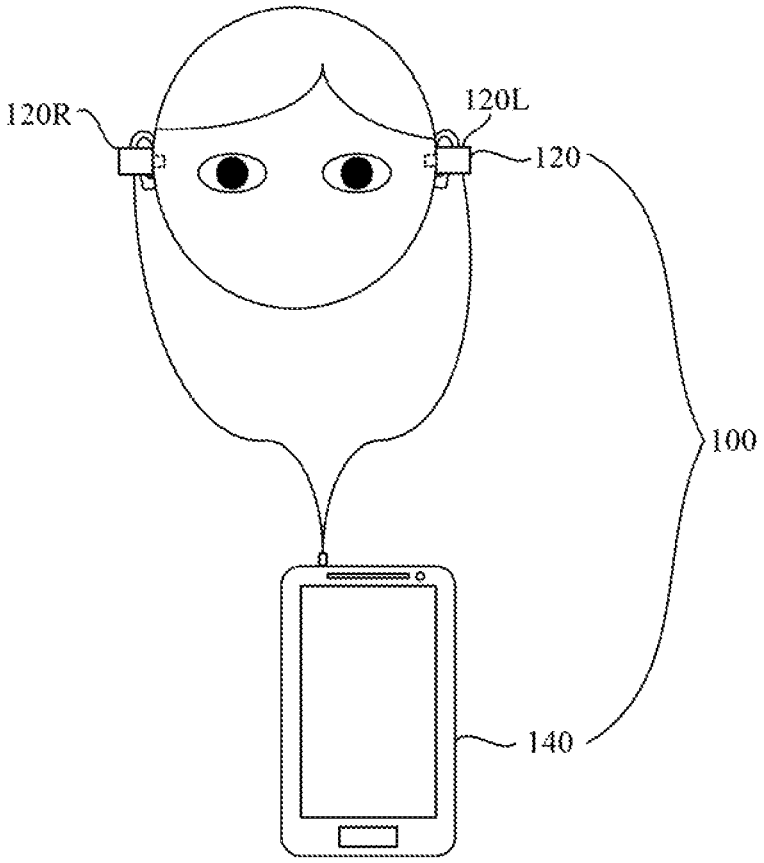
FIG. 1 is a schematic diagram illustrating an audio system according to embodiments of this disclosure.

The following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference is made to FIG. 1, which is a schematic diagram illustrating an audio system 100 according to embodiments of this disclosure. As shown in FIG. 1, the audio system 100 includes a headset 120 and a control device 140 connected to the headset 120. The headset 120 is wearable on ears of a user for audio broadcasting. For example, the headset 120 is an in-ear headphone, an on-ear headphone, or an over-ear headphone. The headset 120 shown in the embodiments of FIG. 1 is an in-ear headphone connected to the control device 140 over a wiring. However, the headset 120 is not limited thereto. In other embodiments, the headset 120 can be wireless connected to the control device 140 over Bluetooth, Bluetooth A2DP, WiFi, WiFi-direct, Zigbee or any equivalent wireless transmission protocol. The headset 120 shown in FIG. 1 includes a right earphone 120R and a left earphone 120L. In this case, the right earphone 120R and the left earphone 120L are both in-ear earbuds.

Figure 2A:
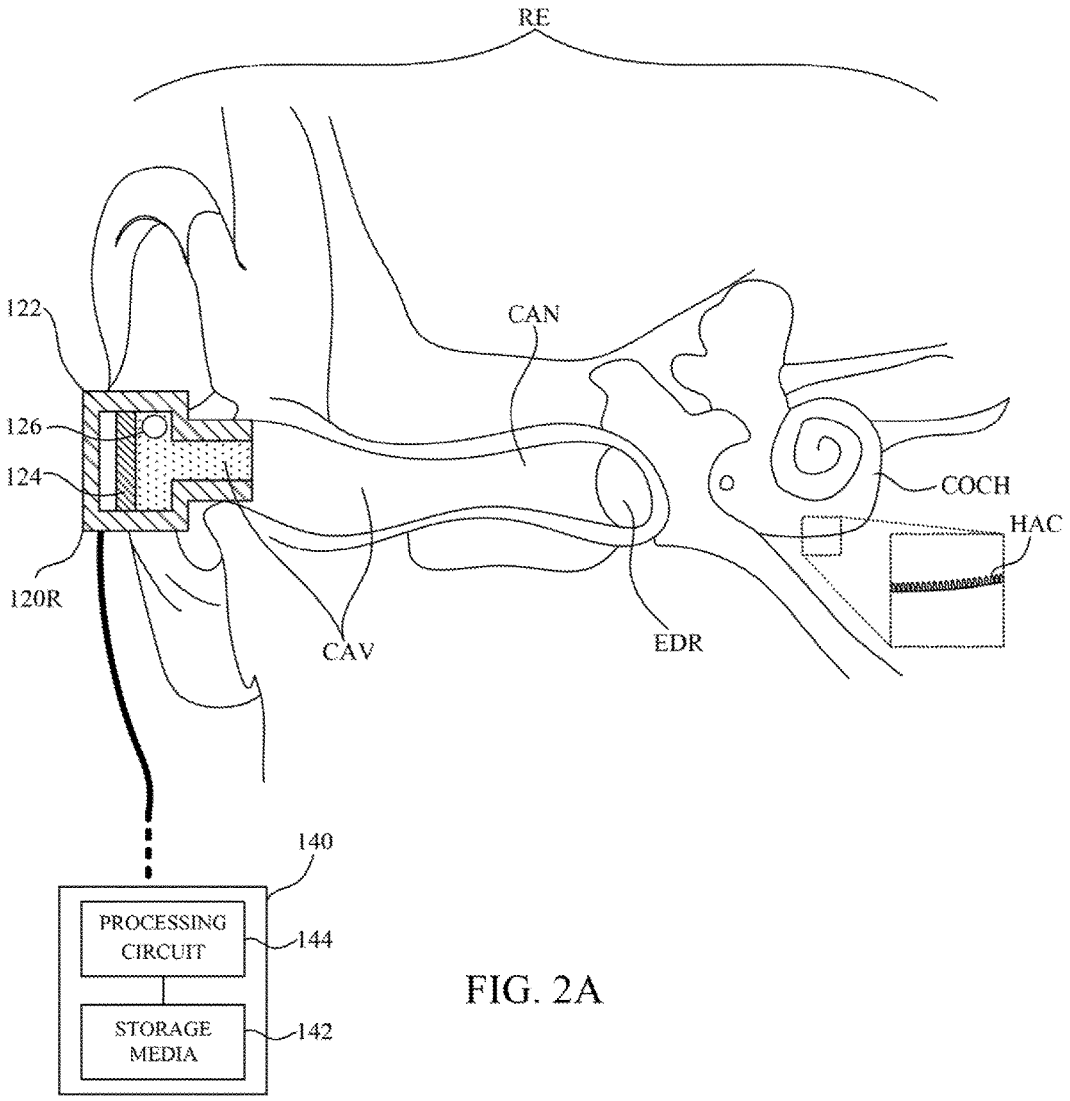
FIG. 2A is a schematic diagram illustrating the right earphone and the control device in FIG. 1.

The control device 140 is an audio source such as a smart phone, a multimedia player, a tablet, a computer, an acoustic system or any equivalent electronic device. Reference is also made to FIG. 2A, which is a schematic diagram illustrating the right earphone 120R and the control device 140 in FIG. 1. The control device 140 as shown in FIG. 2A includes a storage media 142 and a processing circuit 144, such as a processor, an audio driving circuit and/or a digital signal processor, for processing audio signals and controlling audio configuration applied on the headset 120. For example, the storage media 142 includes a flash memory, a hard drive, a read-only memory or any equivalent storage unit.

Referring to FIG. 1 and FIG. 2A, the right earphone 120R of the headset 120 shown in FIG. 2A is mounted on a right ear RE of a user. The right earphone 120R includes a housing 122, a speaker 124 and a microphone 126. The speaker 124 and the microphone 126 are disposed within the housing 122. When the right earphone 120R is mounted on the right ear RE as shown in FIG. 2, the housing 122 forms a cavity CAV along with an external auditory canal CAN of the right ear RE. The speaker 124 is disposed in the housing 122 and located on a side of the cavity CAV. The speaker 124 is utilized to broadcast sound to the cavity CAV and further to the eardrum EDR of the ear. The microphone 126 is disposed in the housing 126, and located within the cavity CAV between the speaker 124 and the eardrum EDR in the embodiments shown in FIG. 2A. The microphone 126 is configured to collect a reflection corresponding to the sound broadcasted by the speaker 124, and accordingly generate a sampled sound signal.

Similarly, the headset 120 also includes the left earphone 120L (shown in FIG. 1) mounted on a left ear of the user. The left earphone 120L is not shown in FIG. 2A and has similar internal structures as the right earphone 120R demonstrated in FIG. 2A and the related embodiments. In other words, the left earphone 120L also includes a housing, a speaker and a microphone.

Since the cavity CAV is a relative small space, when a sound wave is transmitted in the cavity CAV, all points (including locations of the microphone 126 and the eardrum EDR) in the cavity CAV will be sense an approximately equal level of sound pressure induced by the sound wave. In the embodiments, the microphone 126 is able to sense the sound pressure substantially equal (or approximately similar) to the sound pressure sensed by the eardrum EDR. In other words, the sample sound signal sensed by the microphone 126 is able to approach the real sound effect heard by the user because the microphone 126 and the eardrum EDR are located in the same cavity CAV.

When the user wears the headset 120 properly as shown in FIG. 2A, the cavity CAV shall be a concealed space formed by the external auditory canal CAN and partial internal space in the housing 122. In this case, the sound generated by the speaker 124 will be transmitted to the eardrum EDR more precisely and with higher efficiency.

Figure 2B:
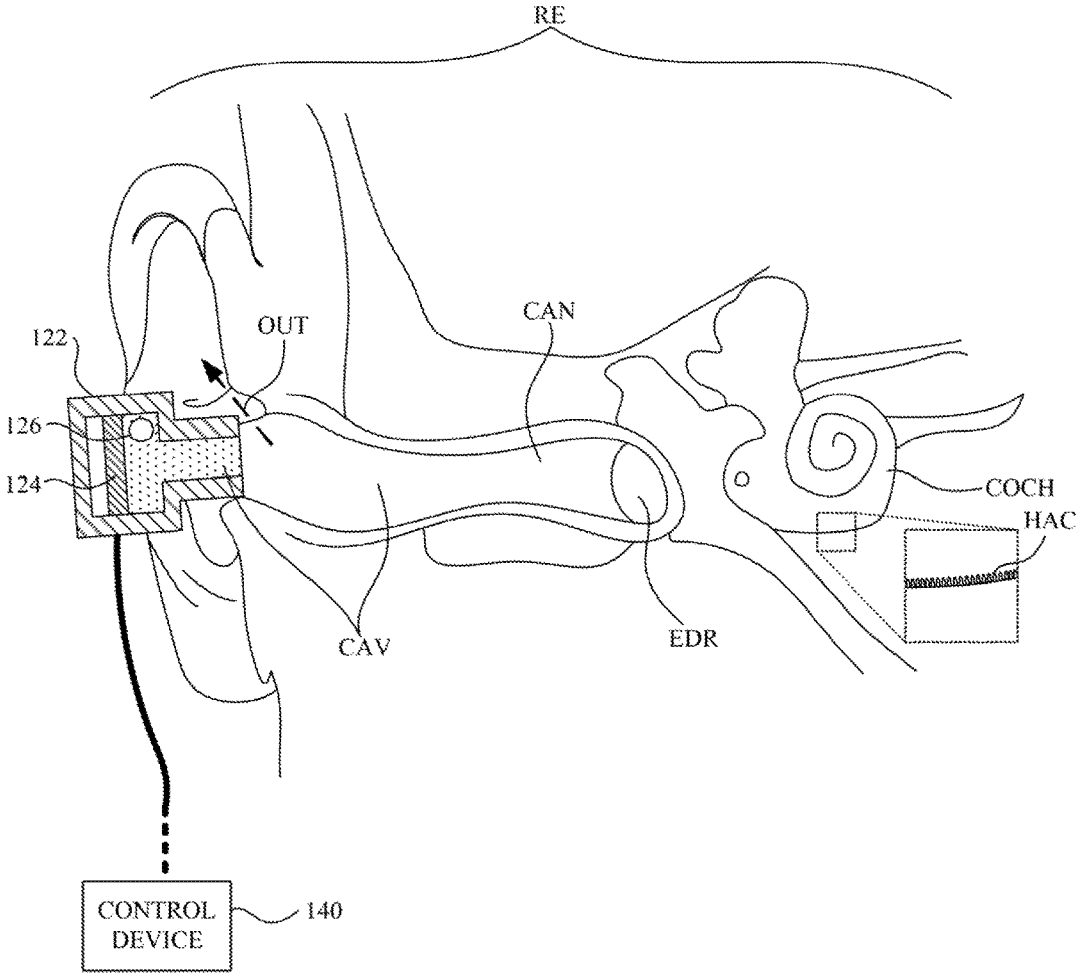
FIG. 2B is a schematic diagram illustrating an example that the right earphone is not properly mounted on the right ear.

Reference is also made to FIG. 2B, which is a schematic diagram illustrating an example that the right earphone 120R is not properly mounted on the right ear RE. As shown in the example of FIG. 2B, when the user fail to wear the headset 120 properly, such as not tuck the right earphone 120R into the external auditory canal CAN, it will create a leakage outlet OUT of the cavity CAV. In this case, the cavity CAV is no longer a perfectly concealed space, and a portion of the sound wave transmitted in the cavity CAV will leak or escape through the leakage outlet OUT. The audio system 100 is able to perform a control method for detecting whether the cavity CAV happen to has the leakage outlet OUT.

Figure 3A:
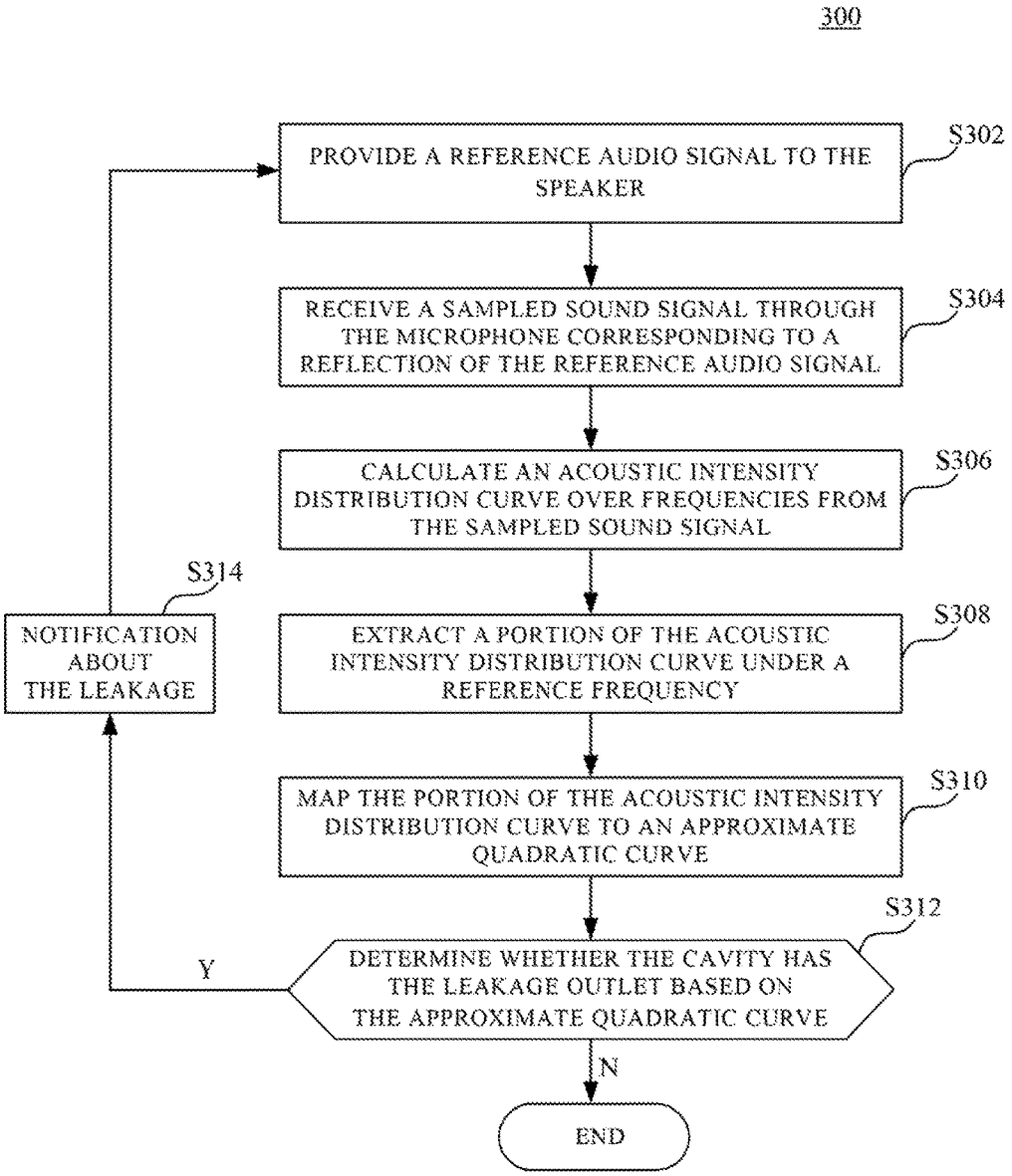
FIG. 3A is a flow diagram illustrating a control method according to embodiments of the disclosure.

Reference is also made to FIG. 3A, which is a flow diagram illustrating a control method 300 according to embodiments of the disclosure. The control method 300 is suitable for the audio system 100 disclosed in aforesaid embodiments or to be applied on any equivalent audio system. It is noticed that the operations S302-S312 of the control method 300 are performed to at both of the right earphone 120R and the left earphone 120L individually. The descriptions of the operations S302-S312 in the following paragraphs are applied to each of the right earphone 120R and the left earphone 120L in parallel (at the same time) or sequentially (one after another).

Figure 4:
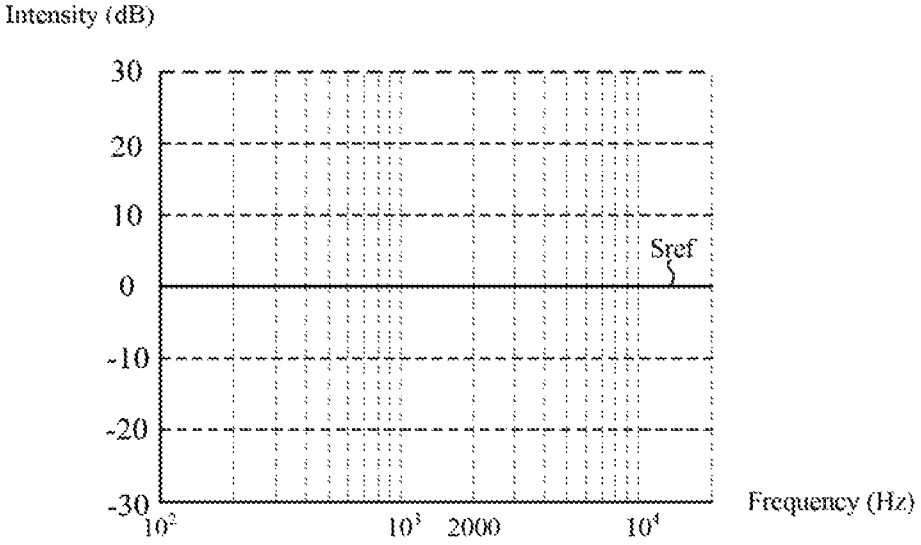
FIG. 4 is a schematic diagram illustrating an acoustic intensity distribution curve over frequencies of the reference audio signal according to embodiments of the disclosure.

Referring to FIG. 2A and FIG. 3A, operation S302 is performed to provide a reference audio signal (e.g., generated by the processing circuit 144 of the control device 140) to the speaker 124 of the right/left earphone 120R/120L to be broadcasted toward the cavity CAV. In some embodiments, the reference audio signal has a consistent level of acoustic intensity over frequencies. Reference is also made to FIG. 4, which is a schematic diagram illustrating an acoustic intensity distribution curve over frequencies of the reference audio signal Sref according to embodiments of the disclosure. As shown in FIG. 4, the acoustic intensity levels of the reference audio signal Sref corresponding to different frequency are all equal.

Referring to FIGS. 1, 2A and 3A, operation S304 is performed to receive a sampled sound signal by the processing circuit 144 of the control device 140. The sampled sound signal is received through the microphone 126 of the right/left earphone 120R/120L from the cavity CAV corresponding to a reflection of the reference audio signal Sref. In this embodiment, two sampled sound signal are respectively collected by the microphone 126 of the right earphone 120R and the microphone (not shown in figures) of the left earphone 120L. Operation S306 is performed to calculate an acoustic intensity distribution curve over frequencies from each one of the sampled sound signals.

Figure 5A:
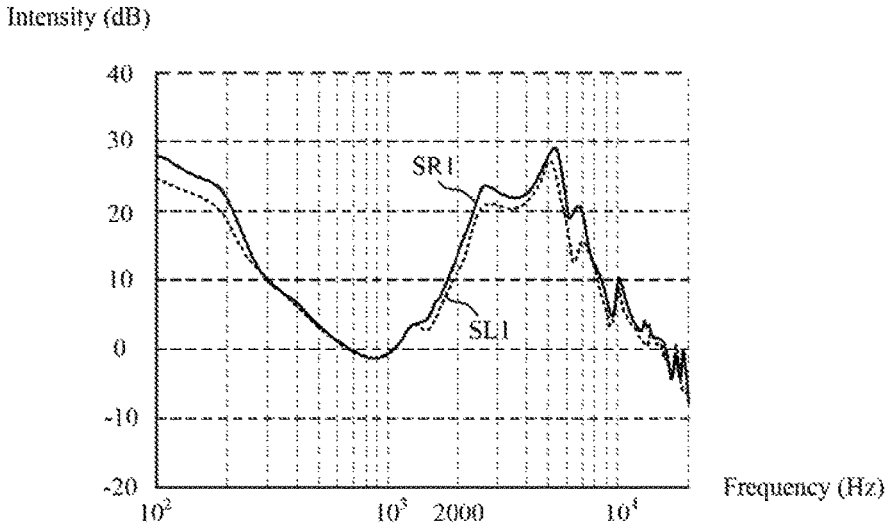
FIG. 5A is a schematic diagram illustrating acoustic intensity distribution curves over frequencies of the sampled sound signal collected from the right earphone and the sampled sound signal collected from the left earphone according to embodiments of the disclosure.

Reference is also made to FIG. 5A, which is a schematic diagram illustrating acoustic intensity distribution curves over frequencies of the sampled sound signal SR1 collected from the right earphone 120R and the sampled sound signal SL1 collected from the left earphone 120L according to embodiments of the disclosure. The acoustic intensity distribution curves of the sampled sound signals SR1 and SL1 are affected by characteristics (including a shape, a size and/or a texture) of the cavity CAV and how the user wears the headset 120 (in a proper way or an improper way). The shape of the cavity CAV may absorb some energy at a specific frequency and amplify the intensity at another frequency. For example, the acoustic intensity around 1000 Hz is relatively lower in sampled sound signals SR1 and SL1, and the acoustic intensity around 5000 Hz is relatively higher in sampled sound signals SR1 and SL1.

Every person has a unique ear structures on his/her own. Therefore, the acoustic intensity distribution curves of the sampled sound signals SR1 and SL1 will be different for every individual person. In addition, the same person may not wear the headset 120 in exactly the same way every time. Therefore, the acoustic intensity distribution curves of the sampled sound signals SR1 and SL1 might be different for the same person at different time points.

FIG. 5A shows the acoustic intensity distribution curves of the sampled sound signals SR1 and SL1 when the user wears the headset 120 properly (referring to FIG. 2A without the leakage outlet).

Figure 5B:
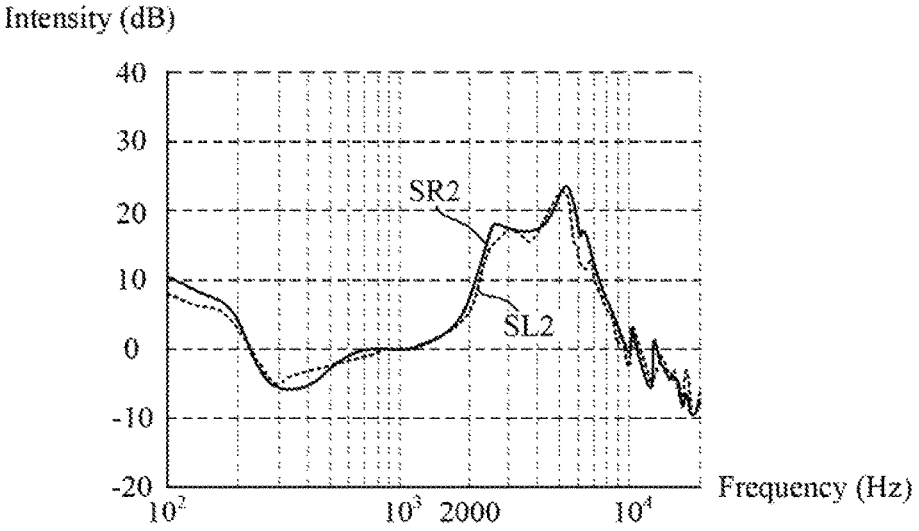
FIG. 5B is a schematic diagram illustrating acoustic intensity distribution curves over frequencies of the sampled sound signal collected from the right earphone and the sampled sound signal collected from the left earphone when the user wears the headset improperly.

Reference is also made to FIG. 5B, which is a schematic diagram illustrating acoustic intensity distribution curves over frequencies of the sampled sound signal SR2 collected from the right earphone 120R and the sampled sound signal SL2 collected from the left earphone 120L when the user wears the headset 120 improperly (referring to FIG. 2B with the leakage outlet OUT of the cavity CAV). When the leakage outlet OUT of the cavity CAV exists, the acoustic intensity will be affected. As shown in FIG. 5A and FIG. 5B, the acoustic intensity levels of the sampled sound signals SR2 and SL2 are relatively lower than the acoustic intensity levels of the sampled sound signals SR1 and SL1. Reduction of the acoustic intensity levels of the sampled sound signals SR2 and SL2 is more obvious in the low frequency portion (e.g., from about 100 Hz to about 2000 Hz). The audio system 100 and the control method 300 are configured to determine whether the cavity CAV has the leakage outlet OUT (referring to FIG. 2B) according to the acoustic intensity distribution curves of the sampled sound signals (referring SR1, SL1, SR2 and SL2 in FIG. 5A and FIG. 5B) over frequencies. One embodiment about how to determine the existence of the leakage outlet OUT according to the acoustic intensity distribution curves is disclosed in the following paragraphs.

Referring to FIG. 3A, after the acoustic intensity distribution curves of the sample sound signals are obtained, operation S308 is performed to extract a portion of the acoustic intensity distribution curve of one sample sound signal under a reference frequency. Operation S310 is performed to map the portion of the acoustic intensity distribution curve of one sample sound signal to an approximate quadratic curve. Operation S312 is performed to determine whether the cavity CAV has the leakage outlet OUT based on at least one coefficient of the approximate quadratic curve. When the leakage outlet OUT is detected in S312, operation S314 is performed to provide a notification about the leakage outlet OUT to the user, such that the user can adjust the locations of the headset 120. Afterward, the method 300 can be repeated operations S302~S312 again to verify whether the user wears the headset 120 properly after the adjustment in S314.

Figure 6A:
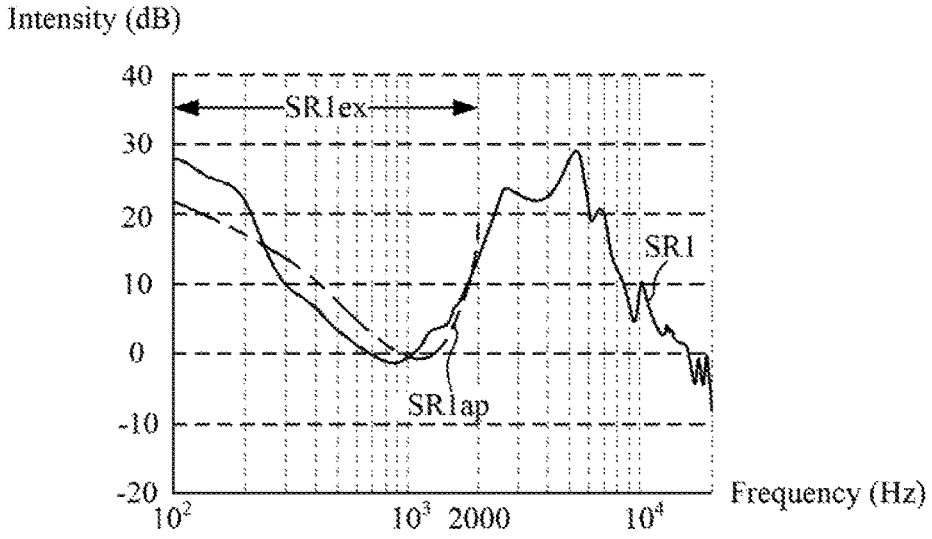
FIG. 6A is a schematic diagram illustrating an approximate quadratic curve generated from the sampled sound signal in FIG. 5A.

Reference to made to FIG. 6A, which is a schematic diagram illustrating an approximate quadratic curve SR1*ap* generated from the sampled sound signal SR1 in FIG. 5A. In operation S308, the portion SR1*ex* of the acoustic intensity distribution curve of the sampled sound signal SR1 under a reference frequency, which is about 2000 Hz in the embodiment. In some other embodiments, the reference frequency is in a range between about 1000 Hz to 5000 Hz. In operation S310, the portion SR1*ex* of the sampled sound signal SR1 is mapped to an approximate quadratic curve SR1*ap*.

The approximate quadratic curve SR1*ap* is created from a quadratic curve in a formula of:

$$y=A+Bx+Cx^2,$$

wherein x is a coordinate along the frequency axis, y is a coordinate along the intensity axis, A, B and C are coefficients of the quadratic curve, A is the height of the quadratic curve and C is the curvature of the quadratic curve.

A binomial regression analysis is performed to the portion SR1*ex* to find out a quadratic curve closest to the portion SR1*ex*. In this case, the formula of approximate quadratic curve SR1*ap* is:

$$y=25.8-4.5x+0.19x^2.$$

In operation S312, the coefficients related to the approximate quadratic curve SR1*ap* (including the curvature, the height and/or aforesaid correlation coefficient) are compared with reference values. If the curvature of the approximate quadratic curve SR1*ap* is larger than 0.1 (i.e., C>0.1), the height of the approximate quadratic curve SR1*ap* is larger than 10 (i.e., A>10) and the correlation coefficient between the approximate quadratic curve SR1*ap* and the portion SR1*ex* is larger than 0.8 (i.e., $\gamma>0.8$), the audio system 100 will determine that there is no leakage outlet on the cavity CAV; otherwise, the audio system 100 will determine that the leakage outlet OUT exists on the cavity CAV.

In this case, a curvature of the approximate quadratic curve SR1*ap* is 0.19, a height of the approximate quadratic curve SR1*ap* is 25.8, and a correlation coefficient ($\gamma$) between the approximate quadratic curve SR1*ap* and the portion SR1*ex* of the sampled sound signal SR1 is 0.91. Therefore, there is no leakage outlet corresponding to the sampled sound signals SR1.

Figure 6B:
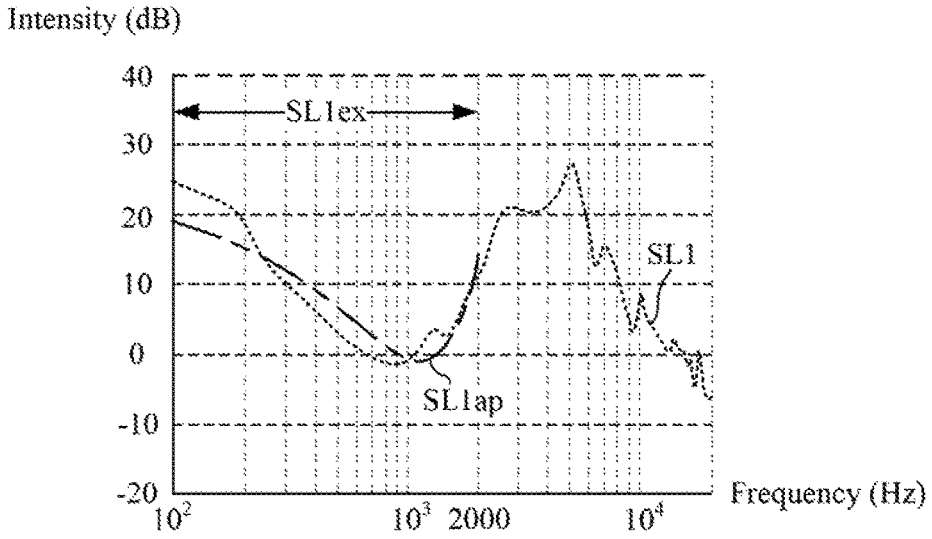
FIG. 6B is a schematic diagram illustrating an approximate quadratic curve generated from the sampled sound signal in FIG. 5A.

Reference to made to FIG. 6B, which is a schematic diagram illustrating an approximate quadratic curve SL1*ap* generated from the sampled sound signal SL1 in FIG. 5A. In operation S308, the portion SL1*ex* of the acoustic intensity distribution curve of the sampled sound signal SL1 under a reference frequency, which is about 2000 Hz in the embodiment. In operation S310, the portion SL1*ex* of the sampled sound signal SL1 is mapped to an approximate quadratic curve SL1*ap*.

A binomial regression analysis is performed to the portion SL1*ex* to find out a quadratic curve closest to the portion SL1*ex*. In this case, the formula of approximate quadratic curve SU ap is:

$$y=23-3.9x+0.16x^2.$$

In operation. S312, the coefficients related to the approximate quadratic curve SL1*ap* (including the curvature, the height and/or aforesaid correlation coefficient) are compared with reference values (i.e., C>0.1, A>10 and γ>0.8).

In this case, a curvature of the approximate quadratic curve SL1*ap* is 0.16, a height of the approximate quadratic curve SL1*ap* is 23, and a correlation coefficient between the approximate quadratic curve SL1*ap* and the portion SL1*ex* of the sampled sound signal SL1 is 0.91. Therefore, there is no leakage outlet corresponding to the sampled sound signals SL1.

Figure 6C:
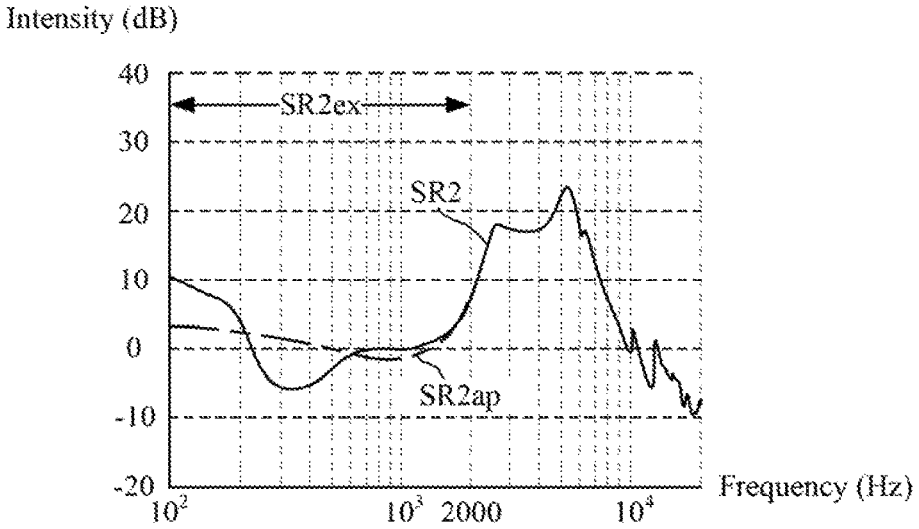
FIG. 6C is a schematic diagram illustrating an approximate quadratic curve generated from the sampled sound signals in FIG. 5B.

Reference to made to FIG. 6C, which is a schematic diagram illustrating an approximate quadratic curve SR2*ap* generated from the sampled sound signals SR2 in FIG. 5B. In operation S308, the portion SR2*ex* of the acoustic intensity distribution curve of the sampled sound signal SR2 under a reference frequency, which is about 2000 Hz in the embodiment. In operation S310, the portion SR2*ex* of the sampled sound signal SR2 is mapped to an approximate quadratic curve SR2*ap*.

A binomial regression analysis is performed to the portion SR2*ex* to find out a quadratic curve closest to the portion SR2*ex*. In this case, the formula of approximate quadratic curve SR2*ap* is:

$$y=4.6+1.2x+0.06x^2.$$

In operation S312, the coefficients related to the approximate quadratic curve SR2*ap* (including the curvature, the height and/or aforesaid correlation coefficient) are compared with reference values (i.e., C>0.1, A>10 and γ>0.8).

In this case, a curvature of the approximate quadratic curve SR2*ap* is 0.06, a height of the approximate quadratic curve SR2*ap* is 4.6, and a correlation coefficient between the approximate quadratic curve SR2*ap* and the portion SR2*ex* of the sampled sound signal SR2 is 0.67. Therefore, a leakage outlet existed on the cavity CAV is detected corresponding to the sampled sound signals SR2. When the audio system 100 and the control method 300 detects the leakage outlet OUT happens to the right earphone 120R, the control method 300 in FIG. 3A performs operation. S314 to provide a notification about the leakage outlet OUT to the user, for example, the audio system 100 can broadcast a warning sound through the speaker 124 or display a notification message on a displayer of the control device 120 for urging the user to adjust the location of the right earphone 120R, such that the user can adjust the right earphone 120R to avoid the leakage outlet OUT.

Figure 6D:
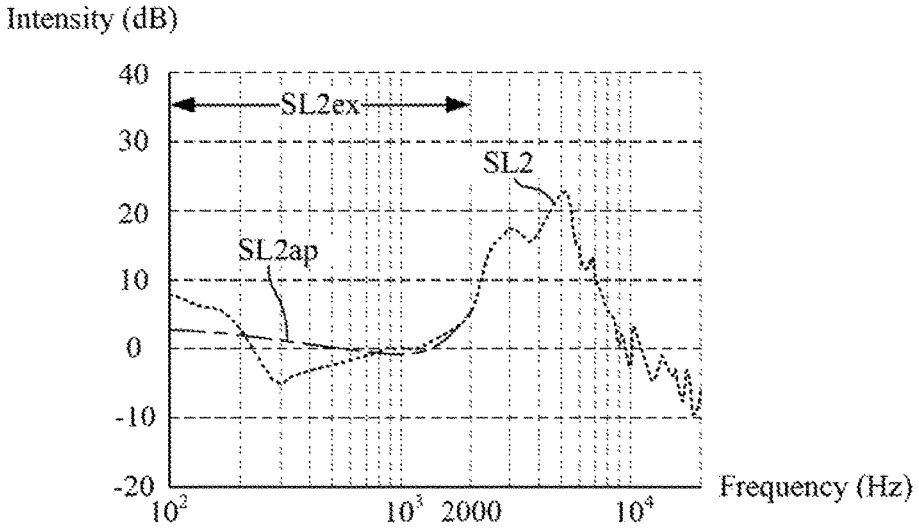
FIG. 6D is a schematic diagram illustrating an approximate quadratic curve generated from the sampled sound signals in FIG. 5B.

Reference to made to FIG. 6D, which is a schematic diagram illustrating an approximate quadratic curve SL2*ap* generated from the sampled sound signals SL2 in FIG. 5B. In operation S308, the portion SL2*ex* of the acoustic intensity distribution curve of the sampled sound signal SL2 under a reference frequency, which is about 2000 Hz in the embodiment. In operation S310, the portion SL2*ex* of the sampled sound signal SL2 is mapped to an approximate quadratic curve SL2*ap*.

A binomial regression analysis is performed to the portion SL2*ex* to find out a quadratic curve closest to the portion SL2*ex*. In this case, the formula of approximate quadratic curve SL2*ap* is:

$$y=3.4-0.9x+0.04x^2.$$

In operation S312, the coefficients related to the approximate quadratic curve SL2*ap* (including the curvature, the height and/or aforesaid correlation coefficient) are compared with reference values (i.e., C>0.1, A>10 and γ>0.8).

In this case, a curvature of the approximate quadratic curve SL2*ap* is 0.04, a height of the approximate quadratic curve SL2*ap* is 3.4, and a correlation coefficient between the approximate quadratic curve SL2*ap* and the portion SL2*ex* of the sampled sound signal SL2 is 0.63. Therefore, a leakage outlet existed on the cavity CAV is detected corresponding to the sampled sound signals SL2. When the audio system 100 and the control method 300 detects the leakage outlet OUT happens to the left earphone 120L, the audio system 100 can broadcast a warning sound through the speaker 124 or display a notification message on a displayer of the control device 120 for urging the user to adjust the location of the left earphone 120L.

Based on aforesaid embodiments, the audio system 100 and the control method 300 are able to determine whether the user wears the right earphone 120R and the left earphone 120L properly or not. When at least one of the right earphone 120R and the left earphone 120L is not worn properly, it can be detected by the sampled sound signal(s) from the right earphone 120R and the left earphone 120L. Accordingly, the audio system 100 and the control method 300 are able to notify the user for correcting the locations of the right earphone 120R and the left earphone 120L, so as to avoid the leakage outlet OUT in FIG. 2B and ensure the concealed condition of the cavity CAV in FIG. 2A.

In some embodiments, the audio system 100 shown in FIG. 1, FIG. 2A and FIG. 2B is further utilized to perform an otoacoustic emission (OAE) test to estimate whether the user suffers hearing obstacles, such as hearing loss, blockage in an outer ear canal, presence of middle ear fluid, damage to outer hair cells in a cochlea of the ear.

As shown in FIG. 2A and FIG. 2B, there is a cochlea COCH in the inner ear of the user. There are hair cells HAC distributed on a surface of the cochlea COCH. When, a sound transmitted to the cochlea COCH, the hair cells HAC will vibrates in accordance with the frequency of the sound, so as to sense the sound. The hair cells HAC at an outer part of the cochlea COCH mainly sense a high frequency portion of the sound, and the hair cells HAC at an inner part of the cochlea COCH mainly sense a low frequency portion of the sound.

When the hair cells HAC in the cochlea COCH are stimulated by an input sound, the hair cells HAC will vibrate in response to the stimulation and generate an otoacoustic emission (OAE). In embodiments of this disclosure, the speaker 124 of the headset 120 is utilized to provide a simulation sound to the ear. When sound stimulates the cochlea, the hair cells HAC vibrate. The vibration produces a nearly inaudible sound that echoes back into the middle ear. In embodiments, the sound can be measured by the microphone 126 of the headset 120.

The OAE test is often part of a newborn hearing screening program. People with normal hearing produce otoacoustic emissions. People with hearing loss greater than 30 dB (due to middle ear trouble) do not produce the otoacoustic emissions. People with hearing loss due to disease of the outer hair cells HAC do not produce the otoacoustic emissions either. The OAE test can detect a blockage in the outer ear canal, a presence of middle ear fluid, and/or a damage to the outer hair cells in the cochlea COCH.

Figure 3B:
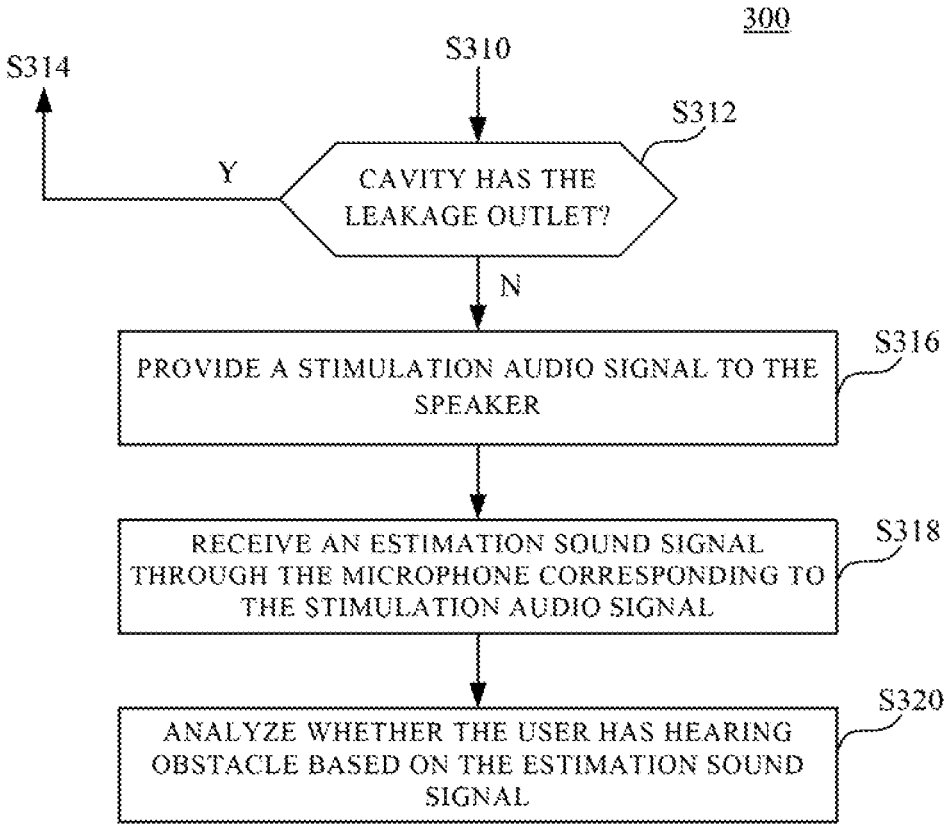
FIG. 3B is a flow diagram illustrating further operations of the control method in FIG. 3A.

Reference is also made to FIG. 3B, which is a flow diagram illustrating further operations of the control method 300 in FIG. 3A. As shown in FIG. 3B, the control method 300 further includes operations S316, S318 and S320 after operation S312.

As shown in FIG. 1, FIG. 2A and FIG. 3B, when the headset 120 is worn properly (i.e., no leakage outlet is detected), operation S316 is performed to provide a stimulation audio signal to the speaker, such that the speaker 124 will broadcast the simulation sound to the ear. Operation S318 is performed to receive an estimation sound signal through the microphone 126 corresponding to the stimulation audio signal. Operation S320 is performed to analyze whether the user has a hearing obstacle based on the estimation sound signal.

In an embodiment, operations S316-S320 adopt a transient evoked OAE (TEOAE) test manner. In TEOAE, the stimulation audio signal includes click stimulus or singular-tone burst stimulus at 1000~4000 Hz. If the user has healthy ears, the outer hair cells HAC will generate OAE feature echoes in response to the click stimulus or singular-tone burst stimulus (i.e., the stimulation audio signal), and the estimation sound signal received by the microphone 126 will include the OAE feature echoes. If the user has the hearing obstacle, there will be no OAE feature echoes in the estimation sound signal received by the microphone 126.

In an embodiment, operations S316-S320 adopt a transient distortion production OAE (DPOAE) test manner. In DPOAE, the stimulation audio signal includes dual tone stimuluses at different frequencies. These dual tone stimuluses reach the cochlea COCH at the same time. Nonlinearity of the cochlea COCH will case total harmonic distortion to these dual tone stimuluses. If the user has healthy ears, the outer hair cells HAC will generate distortion production OAE feature echoes in response to the dual tone stimuluses (i.e., the stimulation audio signal), and the estimation sound signal received by the microphone 126 will include the distortion production OAE feature echoes, which should be louder than 6 dB. If the user has the hearing obstacle, the distortion production OAE feature echoes in the estimation sound signal received by the microphone 126 should be lower than 6 dB or not existed.

In other words, the headset 120 of the audio system 100 shown in FIG. 1, FIG. 2A and FIG. 2B are able to be utilized to detect whether the user has the hearing obstacle by broadcasting the stimulation audio signal to the ear, receiving the estimation sound signal, and analyzing the result of the estimation sound signal to see if the estimation sound signal includes the CAE feature echoes.

Figure 7:
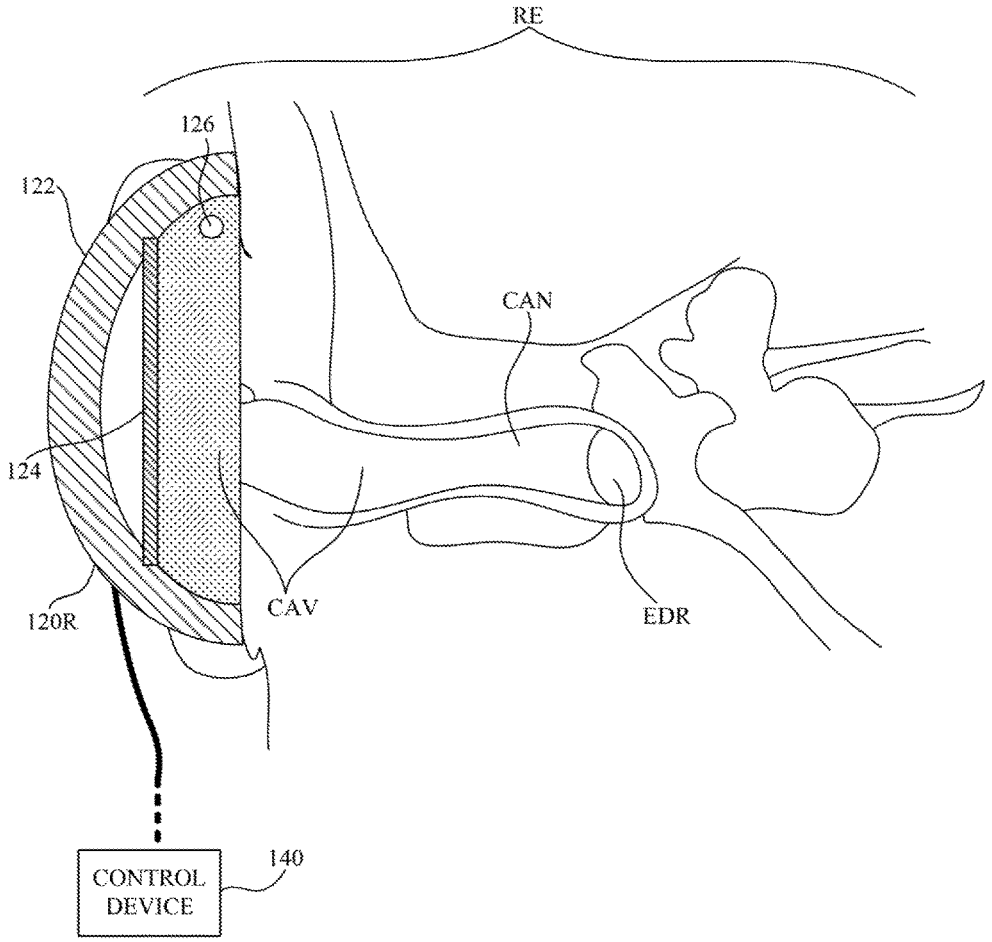
FIG. 7 is a schematic diagram illustrating the right earphone and the control device in FIG. 1 according to other embodiments.

The headset 120 of the audio system 100 shown in FIG. 1, FIG. 2A and FIG. 2B is an in-ear headphone. However, the disclosure is not limited thereto. Reference is also made to FIG. 7, which is a schematic diagram illustrating the right earphone 120R and the control device 140 in FIG. 1 according to other embodiments. The right earphone 120R shown in FIG. 7 is an over-ear earphone. As shown in FIG. 7, the right earphone 120R includes a housing 122, a speaker 124 and a microphone 126. Compared to in-ear earphone 120R in FIG. 2A and FIG. 2B, the cavity CAV formed by the housing 122 and the external auditory canal CAN is relatively larger. It will not affect functions and behaviors of the over-ear right earphone 1208 in FIG. 7. The functions and behaviors of the speaker 124 and the microphone 126 of the over-ear right earphone 120R in FIG. 7 are similar to the in-ear earphone 120R demonstrated in aforesaid embodiments, and not to be repeated here again.

Figure 8:
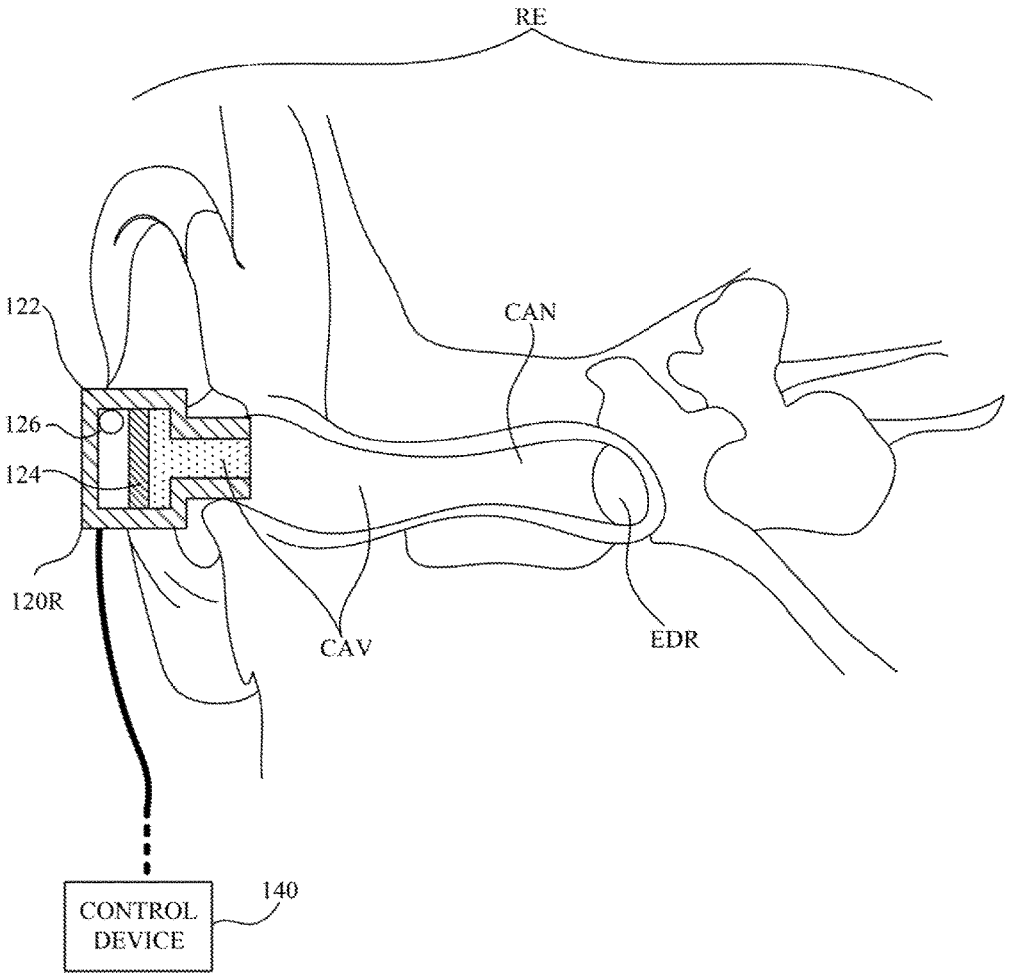
FIG. 8 is a schematic diagram illustrating the right earphone and the control device in FIG. 1 according to other embodiments.

In aforesaid embodiments in FIG. 2A, FIG. 2B and FIG. 7, the microphone 126 is located in the cavity CAV between the speaker 124 and the eardrum EDR. However, the disclosure is not limited thereto. Reference is also made to FIG. 8, which is a schematic diagram illustrating the right earphone 120R and the control device 140 in FIG. 1 according to other embodiments. The right earphone 120R shown in FIG. 8 is an in-ear earphone. As shown in FIG. 8, the right earphone 120R includes a housing 122, a speaker 124 and a microphone 126. Compared to the in-ear earphone 120R in FIG. 2A, FIG. 2B and the over-ear earphone 120R in FIG. 7, the microphone 126 in FIG. 8 is disposed within the housing 122 and outside the cavity CAV. In this case, the microphone 126 will not directly sense the sound pressure within the cavity CAV. The sound pressure within the cavity CAV will induce a vibration of the housing 122 which is transmitted to the microphone 126. Therefore, the microphone 126 will sense the sound pressure within the cavity CAV indirectly through a transduction of the housing 122 of the right earphone 120R. In this case, the sampled sound signal generated by the microphone 126 is further adjusted by a transduction coefficient of the housing 122. The transduction coefficient is decided by a material, a shape and/or a structure of the housing 122. The transduction coefficient can be obtained from a testing procedure after the headset 120 is manufactured.

After the sampled sound signal is calibrated by the transduction coefficient, the sampled sound signal can be utilized to determine whether the cavity has the leakage outlet (through operations S306 to S312 shown in FIG. 3A). The behaviors of the operations S306 to S312 in FIG. 3A are similar to aforesaid embodiments, and not to be repeated here again.

Every person has a unique ear structures on his/her own. Even the same person will has different ear structures between his/her right ear and left ear. In addition, the user may not wear the headset 120 in the exact same way every time. When the same audio content is broadcasted to the ears of the user, a certain degree of distortion will occur to the audio content. The audio system 100 able to perform a control method for compensating the audio content so as to eliminate the distortion induced by the ear structures and/or the wearing position of the headset 120.

Figure 9:
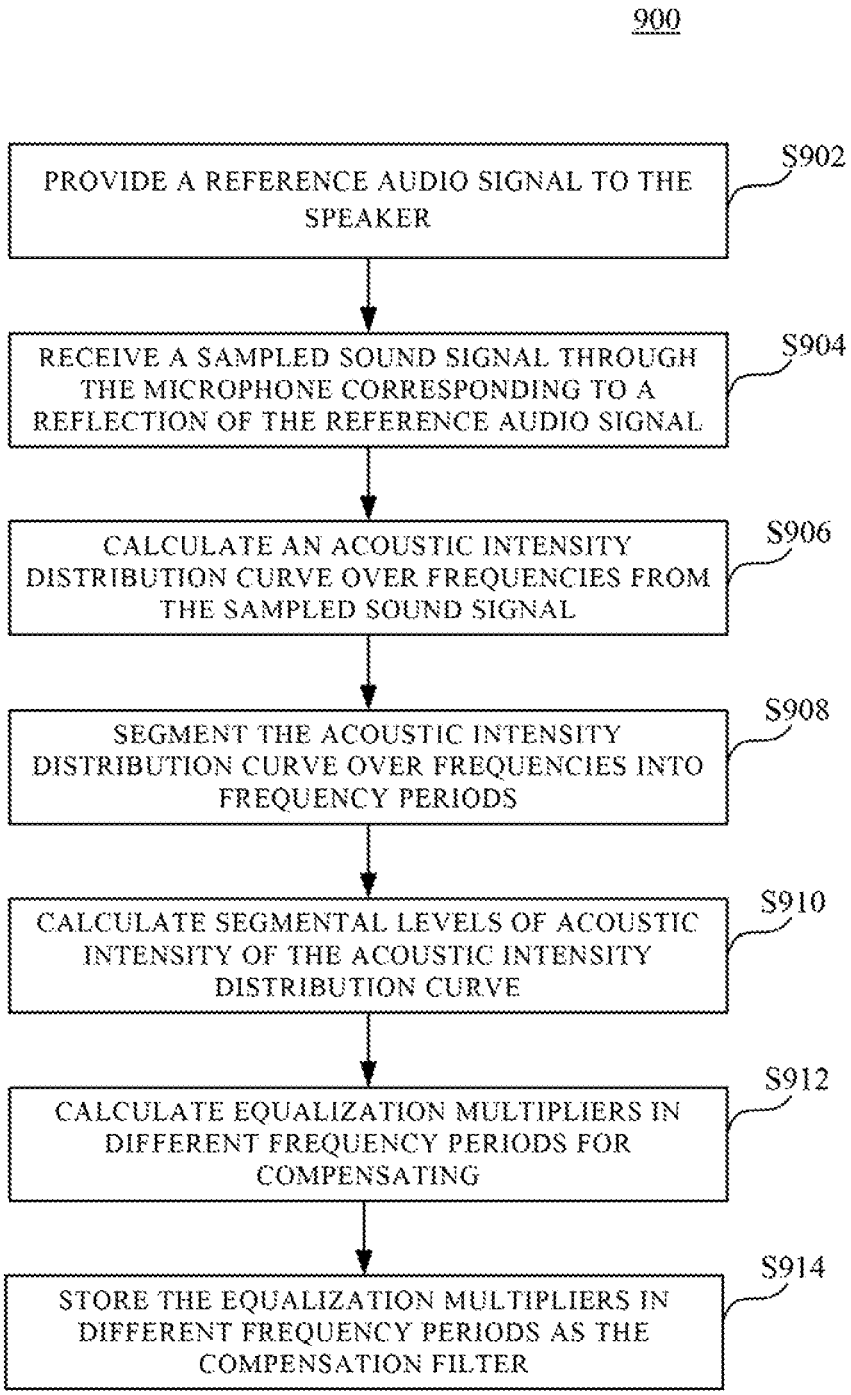
FIG. 9 is a flow diagram illustrating a control method according to embodiments of the disclosure.

Reference is also made to FIG. 9, which is a flow diagram illustrating a control method 900 according to embodiments of the disclosure. The control method 900 is suitable for the audio system 100 and the related embodiments in FIG. 1, FIG. 2A, FIG. 2B, FIG. 7 and FIG. 8 or to be applied on any equivalent audio system. It is noticed that the operations S902-S914 of the control method 900 are performed to at both of the right earphone 120R and the left earphone 120L individually. The descriptions of the operations S902-S912 in the following paragraphs are applied to each of the right earphone 120R and the left earphone 120L in parallel (at the same time) or sequentially (one after another).

Referring to FIG. 2A and FIG. 9, operation S902 is performed to provide a reference audio signal to the speaker 124 to be broadcasted toward the cavity CAV. Referring to FIG. 4, the reference audio signal Sref has a consistent level of acoustic intensity over frequencies.

Figure 10A:
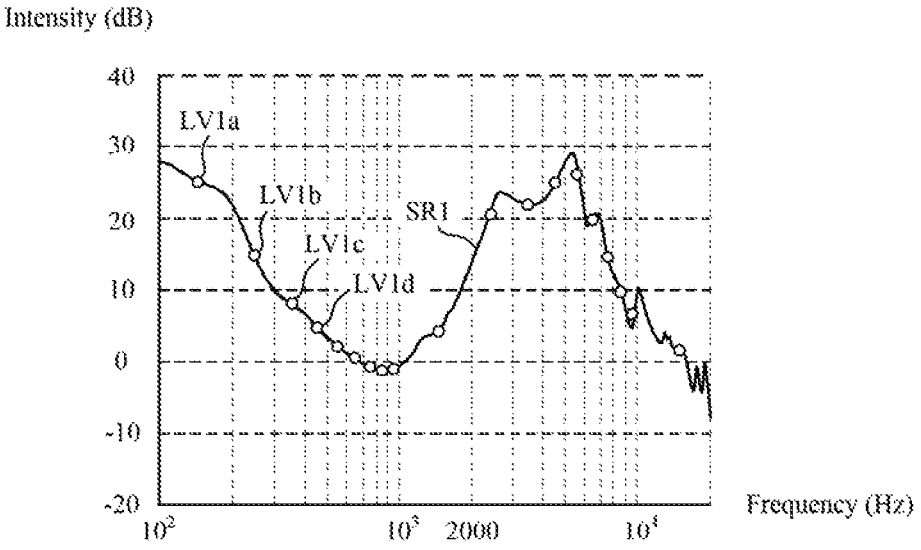
FIG. 10A is a schematic diagram illustrating acoustic intensity distribution curve over frequencies of the sampled sound signal collected from the right earphone according to embodiments of the disclosure.

Operation S904 is performed to receive a sampled sound signal by the processing circuit 144 of the control device 140 through the microphone 126 from the cavity CAV corresponding to a reflection of the reference audio signal Sref. Operation S906 is performed to calculate an acoustic intensity distribution curve over frequencies from the sampled sound signal by the processing circuit 144 of the control device 140. Reference is also made to FIG. 10A, which is a schematic diagram illustrating acoustic intensity distribution curve over frequencies of the sampled sound signal SR1 collected from the right earphone 120R according to embodiments of the disclosure.

Referring to FIG. 2A, FIG. 9 and FIG. 10A, operation S908 is performed to segment the acoustic intensity distribution curve of the sampled sound signal SR1 over frequencies into a plurality of frequency periods by the processing circuit 144. In embodiments shown in FIG. 10A, the frequency periods of the sampled sound signal SR1 is segmented into 100 Hz~200 Hz, 200 Hz~300 Hz, 300 Hz~400 Hz, . . . 900 Hz~1000 Hz, 1000 Hz~2000 Hz, 2000 Hz~3000 Hz, . . . 9000 Hz~10000 Hz and 10000 Hz 20000 Hz. The segment manner is not limited thereto. In some other embodiments, the frequency periods can be segmented into every 100 Hz, every 500 Hz, every 1000 Hz, every 2000 Hz, etc.

Referring to FIG. 2A, FIG. 9 and FIG. 10A, operation S910 is performed to calculate segmental levels of acoustic intensity of the acoustic intensity distribution curve of the sampled sound signal SR1 in different frequency periods respectively by the processing circuit 144. As shown in FIG. 10A, a segmental level LV1*a* is calculated corresponding to 100 Hz~200 Hz; a segmental level LV1*b* is calculated corresponding to 200 Hz~300 Hz; a segmental level LV1*c* is calculated corresponding to 300 Hz~400 Hz; and, a segmental level LV1*d* is calculated corresponding to 400 Hz 500 Hz. In this case, the segmental level LV1*a* is higher than the segmental level LV1*b*. The segmental level LV1*b* is higher than the segmental level LV1*c*. The segmental level LV1*c* is higher than the segmental level LV1*d*. There are more segmental levels shown in FIG. 10A. For brevity of figures and descriptions, four segmental levels LV1*a*~LV1*d* are explained here for demonstration. Other segmental levels are also processed correspondingly.

Figure 10B:
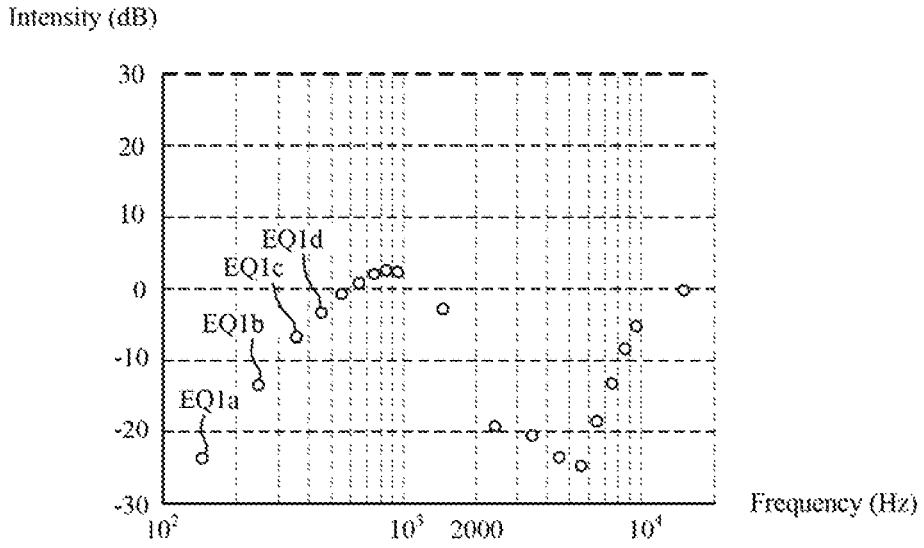
FIG. 10B is a schematic diagram illustrating the equalization multipliers corresponding to the segmental levels shown in FIG. 10A for compensating the sampled sound signal.

Operation S912 is performed to calculate equalization multipliers in different frequency periods for compensating each of the segmental levels to a consistent level by the processing circuit 144. Reference is made to FIG. 10B, which is a schematic diagram illustrating the equalization multipliers EQ1*a*~EQ1*d* corresponding to the segmental levels LV1*a*~LV1*d* shown in FIG. 10A for compensating the sampled sound signal SR1. The levels of the equalization multipliers EQ1*a*~EQ1*d* are negatively correlated with the segmental levels LV1*a*~LV1*d*. In this case, the equalization multiplier EQ1*a* is lower than the equalization multiplier EQ1*b*. The equalization multiplier EQ1*b* is lower than the equalization multiplier EQ1*c*. The equalization multiplier EQ1*c* is lower than the equalization multiplier EQ1*d*. In some embodiments, products of the equalization multipliers EQ1*a*~EQ1*d* and the corresponding segmental levels LV1*a*~LV1*d* are equal to 1.

Operation S914 is performed to store the equalization multipliers (including EQ1*a*~EQ1*d*) in different frequency periods as a compensation filter by the processing circuit 144. In some embodiments, the compensation filter is stored into the storage media 142. In other words, the compensation filter is created according to the acoustic intensity distribution curve over frequencies of the sampled sound signal SR1 The compensation filter is utilized to compensate the distortion induced by audio playing conditions (including ear structures and/or headphone positions).

When the audio system 100 is going to broadcast an audio content signal (e.g., a soundtrack, a song, a voice message or any audio data), the compensation filter is applied to the audio content signal by the processing circuit 144 before the audio content signal is transmitted to the speaker 124, so as to enhance/reduce the intensity level of the audio content signal in different frequency periods. Therefore, the audio content signal can be heard by the users with less distortion. Based on the control method 900, the compensation filters for left ear and right ear are established individually according to the sampled sound signals from two earphones. Therefore, the compensation filters will be customized to a specific ear of a specific user. The control method 900 can be executed every time before the audio content signal is transmitted to the speaker 124, such that the compensation filters will be dynamically adjusted from time to time.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An audio system, comprising:

a headset, comprising:

a housing configured for forming a cavity along with an external auditory canal of an ear when the headset being mounted on the ear;

a speaker disposed in the housing; and a microphone disposed in the housing; and a control device, coupled to the headset, wherein the control device is operable to:

provide a reference audio signal to the speaker to be broadcasted toward the cavity;

receive a sampled sound signal through the microphone from the cavity corresponding to a reflection of the reference audio signal;

calculate an acoustic intensity distribution curve over frequencies from the sampled sound signal;

extract a portion of the acoustic intensity distribution curve under a reference frequency;

map the portion of the acoustic intensity distribution curve to an approximate quadratic curve, wherein the approximate quadratic curve is created from a quadratic curve in a formula of $y=A+Bx+Cx^2$, x is a coordinate along a frequency axis, y is a coordinate along an intensity axis, A, B and C are coefficients of the quadratic curve; and determine whether the cavity has a leakage outlet based on at least one coefficient of the approximate quadratic curve.

2. The audio system of claim 1, wherein the reference audio signal has a consistent level of acoustic intensity over frequencies.

3. The audio system of claim 1, wherein the at least one coefficient comprises a curvature of the approximate quadratic curve, a height of the approximate quadratic curve or a correlation coefficient between the portion of the acoustic intensity distribution curve and the approximate quadratic curve.

4. The audio system of claim 1, wherein the microphone is located between the speaker and the external auditory canal, and the microphone is disposed within the cavity.

5. The audio system of claim 1, wherein the microphone is disposed outside the cavity, the sampled sound signal is adjusted by a transduction coefficient of the housing.

6. The audio system of claim 1, wherein the control device is operable to:

provide a stimulation audio signal to the speaker;

receive an estimation sound signal through the microphone corresponding to the stimulation audio signal; and analyze whether a user of the headset has a hearing obstacle based on the estimation sound signal.

7. The audio system of claim 1, wherein the control device is further operable to:

create a compensation filter according to the acoustic intensity distribution curve over frequencies; and apply the compensation filter to an audio content signal before the audio content signal is transmitted to the speaker.

8. The audio system of claim 7, wherein the control device is further operable to:

segment the acoustic intensity distribution curve over frequencies into a plurality of frequency periods;

calculate a plurality of segmental levels of acoustic intensity of the acoustic intensity distribution curve in different frequency periods respectively;

calculate a plurality of equalization multipliers in different frequency periods for compensating each of the segmental levels to a consistent level; and store the equalization multipliers in different frequency periods as the compensation filter.

9. An audio system, comprising:

a headset, comprising:

a housing configured for forming a cavity along with an external auditory canal of an ear when the headset being mounted on the ear;

a speaker disposed in the housing; and a microphone disposed in the housing; and a control device coupled to the headset, wherein the control device is operable to:

provide a reference audio signal to the speaker to be broadcasted toward the cavity;

receive a sampled sound signal through the microphone corresponding to a reflection of the reference audio signal from the cavity; and calculate an acoustic intensity distribution curve over frequencies from the sampled sound signal;

extract a portion of the acoustic intensity distribution curve under a reference frequency;

map the portion of the acoustic intensity distribution curve to an approximate quadratic curve, wherein the approximate quadratic curve is created from a quadratic curve in a formula of $y=A+Bx+Cx^2$, x is a coordinate along a frequency axis, y is a coordinate along an intensity axis, A, B and C are coefficients of the quadratic curve;

determine whether the cavity has a leakage outlet based on at least one coefficient of the approximate quadratic curve; and calculate a compensation filter according to the acoustic intensity distribution curve over frequencies.

10. The audio system of claim 9, wherein the control device is further operable to apply the compensation filter to an audio content signal before the audio content signal is transmitted to the speaker.

11. The audio system of claim 9, wherein the control device is further operable to:

segment the acoustic intensity distribution curve over frequencies into a plurality of frequency periods;

calculate a plurality of segmental levels of acoustic intensity of the acoustic intensity distribution curve in different frequency periods respectively;

calculate a plurality of equalization multipliers in different frequency periods for compensating each of the segmental levels to a consistent level; and store the equalization multipliers in different frequency periods as the compensation filter.

12. The audio system of claim 9, wherein the microphone is located between the speaker and the external auditory canal, and the microphone is disposed within the cavity.

13. The audio system of claim 9, wherein the microphone is disposed outside the cavity, the sampled sound signal is adjusted by a transduction coefficient of the housing.

14. A control method, suitable for a headset, the control method comprising:

providing a reference audio signal to be broadcasted toward a cavity formed by the headset and an external auditory canal of an ear;

receiving a sampled sound signal by the headset corresponding to a reflection of the reference audio signal from the cavity;

calculating an acoustic intensity distribution curve over frequencies from the sampled sound signal;

extracting a portion of the acoustic intensity distribution curve under a reference frequency;

mapping the portion of the acoustic intensity distribution curve to an approximate quadratic curve, wherein the approximate quadratic curve is created from a quadratic curve in a formula of $y=A+Bx+Cx^2$, x is a coordinate along a frequency axis, y is a coordinate along an intensity axis A, B and C are coefficients of the quadratic curve; and determining whether the cavity has a leakage outlet based on at least one coefficient of the approximate quadratic curve.

15. The control method of claim 14, wherein the control method comprising:

extracting a portion of the acoustic intensity distribution curve under a reference frequency;

mapping the portion of the acoustic intensity distribution curve to an approximate quadratic curve; and determining whether the cavity has the leakage outlet based on at least one coefficient of the approximate quadratic curve.

16. The control method of claim 14, wherein the control method comprising:

provide a stimulation audio signal to be broadcasted toward a cavity formed by the headset and an external auditory canal of an ear;

receive an estimation sound signal by the headset corresponding to the stimulation audio signal; and analyze whether a user of the headset has a hearing obstacle based on the estimation sound signal.

17. The control method of claim 14, further comprising:

creating a compensation filter according to the acoustic intensity distribution curve over frequencies; and applying the compensation filter to an audio content signal before the audio content signal is broadcasted by the headset.

18. The control method of claim 17, further comprising:

segmenting the acoustic intensity distribution curve over frequencies into a plurality of frequency periods;

calculating a plurality of segmental levels of acoustic intensity of the acoustic intensity distribution curve in different frequency periods respectively;

calculating a plurality of equalization multipliers in different frequency periods for compensating each of the segmental levels to a consistent level; and storing the equalization multipliers in different frequency periods as the compensation filter.

19. The control method of claim 14, further comprising:

adjusting the sampled sound signal according to a transduction coefficient of the headset.

20. The control method of claim 14, wherein the reference audio signal has a consistent level of acoustic intensity over frequencies.

* * * * *